US007516938B2

(12) United States Patent
Funari et al.

(10) Patent No.: US 7,516,938 B2
(45) Date of Patent: Apr. 14, 2009

(54) FLUSH VALVE DIAPHRAGM ORIFICE INSERT AND RIB DESIGN

(75) Inventors: Michael A. Funari, Apex, NC (US); J. Timothy O'Connor, Whispering Pines, NC (US)

(73) Assignee: Zurn Industries, LLC, Erie, PA (US)

( * ) Notice: Subject to any disclaimer, the term of this patent is extended or adjusted under 35 U.S.C. 154(b) by 0 days.

(21) Appl. No.: 11/512,445

(22) Filed: Aug. 30, 2006

(65) Prior Publication Data

US 2006/0289817 A1 Dec. 28, 2006

Related U.S. Application Data

(62) Division of application No. 10/615,614, filed on Jul. 8, 2003, now Pat. No. 6,971,634.

(60) Provisional application No. 60/394,472, filed on Jul. 8, 2002.

(51) Int. Cl.
*F16K 31/145* (2006.01)

(52) U.S. Cl. ..... 251/40; 251/38

(58) Field of Classification Search ..... 251/38, 251/40, 331, 118, 120; 137/544–550
See application file for complete search history.

(56) References Cited

U.S. PATENT DOCUMENTS

| | | | | |
|---|---|---|---|---|
| 639,903 | A | 12/1899 | Mueller | |
| 982,434 | A | 1/1911 | Koss | |
| 1,201,268 | A | 10/1916 | Davis | |
| 1,714,573 | A * | 5/1929 | Sloan | 251/61.1 |
| 1,756,263 | A | 4/1930 | Sloan | |
| 1,878,001 | A | 9/1932 | Sloan | |
| 2,916,251 | A | 12/1959 | Butts | |
| 3,011,758 | A | 12/1961 | McFarland, Jr. | |
| 3,154,288 | A | 10/1964 | Tripoli | |
| 3,951,167 | A | 4/1976 | Howell et al. | |
| 4,261,545 | A | 4/1981 | Allen | |
| 4,272,052 | A | 6/1981 | Gidner | |
| 4,327,891 | A | 5/1982 | Allen et al. | |
| 4,579,147 | A | 4/1986 | Davies et al. | |
| 5,107,887 | A | 4/1992 | White et al. | |
| 5,125,621 | A | 6/1992 | Parsons et al. | |
| 5,150,877 | A | 9/1992 | Whiteside et al. | |
| 5,201,492 | A | 4/1993 | Beauvir | |
| 5,213,305 | A | 5/1993 | Whiteside et al. | |
| 5,295,655 | A | 3/1994 | Wilson et al. | |
| 5,332,192 | A | 7/1994 | Whiteside | |

(Continued)

*Primary Examiner*—Stephen M Hepperle
*Assistant Examiner*—Andrew J Rost
(74) *Attorney, Agent, or Firm*—The Webb Law Firm

(57) ABSTRACT

A diaphragm assembly for use in conventional diaphragm-type flush valves includes a flexible diaphragm body having a first side and a second side and a bypass orifice filter insert defined in the diaphragm body. The second side of the diaphragm body includes an annular protrusion and a plurality of protruding ribs, wherein a recess area is defined between the rib and the protrusion. When a pressure difference is applied across the diaphragm body, the second side of the diaphragm body is concave and the first side of the diaphragm body is convex, whereby a distance between the rib and the protrusion decreases in order to prevent the diaphragm body from closing two quickly against a valve seat of a flush valve. A method for controlling pressure differences across the diaphragm body is also disclosed.

6 Claims, 4 Drawing Sheets

U.S. PATENT DOCUMENTS 5,335,694 A 8/1994 Whiteside
5,337,785 A 8/1994 Römer
5,388,610 A 2/1995 Chuang
5,456,279 A 10/1995 Parsons et al.
5,490,659 A 2/1996 Whiteside
5,649,686 A 7/1997 Wilson
5,816,731 A 10/1998 Howard
5,836,571 A 11/1998 Streitman et al.
5,887,848 A * 3/1999 Wilson ..... 251/40
5,909,747 A 6/1999 Schieber
5,967,182 A 10/1999 Wilson
6,095,484 A 8/2000 Frenkel
6,182,689 B1 2/2001 Lauer et al.
6,216,730 B1 4/2001 Hall
6,260,576 B1 7/2001 Allen
6,299,128 B1 10/2001 Verdecchia
6,616,119 B2 9/2003 Wilson

* cited by examiner (PRIOR ART) FIG. 1

FLUSH VALVE DIAPHRAGM ORIFICE INSERT AND RIB DESIGN

CROSS REFERENCE TO RELATED APPLICATION

This application is a divisional of U.S. patent application Ser. No. 10/615,614, filed Jul. 8, 2003, which claims the benefit of U.S. Provisional Patent Application Ser. No. 60/394,472, filed Jul. 8, 2002, which is hereby incorporated by reference.

BACKGROUND OF THE INVENTION

1. Field of the Invention

The present invention relates, in general, to a flush valve diaphragm for urinals and other plumbing equipment and, more particularly, to a flush valve diaphragm rib design and bypass orifice filter insert.

2. Description of Related Art

Typical diaphragm-type flush valves for use on toilet devices, such as urinals and water closets, utilize a flexible diaphragm to establish and to seal off the connection between an inlet and outlet of a flush valve. Typically, the diaphragm is made of an elastomeric material, such as rubber, and includes a filter and a bypass orifice which provides fluid communication between the inlet side of the flush valve and an upper chamber of the flush valve. Such flush valve diaphragms are described in U.S. Pat. No. 6,299,128 B1, which is hereby incorporated by reference in its entirety.

The performance of prior art diaphragm-type flush valves can depend upon how well the diaphragm seals off the connection between the inlet and the outlet. Inadequate sealing of the diaphragm can occur when a diaphragm loses its elasticity and becomes distorted due to the constant flexing of the diaphragm after extensive use. The performance also depends on the pressure drop between the opposite sides of the diaphragm due to the bypass orifice. A clogged bypass orifice can prevent water from flowing to the top side of the diaphragm, which results in an inadequate seal. It is desirable to provide a filtering element with the bypass orifice in order to eliminate effectively particulates, which may clog the water passageway of the bypass orifice. In addition, water hammer resulting from the diaphragm closing too quickly against the valve body can also be a problem that affects the performance of the flush valve.

It is, therefore, an object of the present invention to eliminate the above-mentioned deficiencies by providing a diaphragm assembly with improved performance, longer useful life, and service in diaphragm-type flush valves.

SUMMARY OF THE INVENTION

The present invention provides for a bypass orifice filter insert for use in a flush valve diaphragm that includes an annular-shaped first body having ends and a tapered or a frusto-conical-shaped second body attached to the first body. The first body having a flange attached to each end defines an orifice. The second body which is attached to the first body via the flange defines a slit, wherein the slit of the second body is in fluid communication with the orifice in the first body. The bypass orifice filter insert can be made from a unitary piece of molded material.

The present invention also provides for a diaphragm for use in a diaphragm-type flush valve. The diaphragm includes a flexible diaphragm body having a first side and a second side and defining an outer periphery, a center passageway defined in the diaphragm body, an annular protrusion defined on the second side of the diaphragm body adjacent the center passageway, and a plurality of protruding ribs having a first end and a second end defined on the second side of the diaphragm body adjacent the protrusion. The first end of each rib extends radially outward away from the center passageway toward the second end of the rib. A recess area is defined between the first end of the rib and the protrusion. When a pressure difference is applied across said diaphragm body, the second side of the diaphragm body is concave and the first side of the diaphragm body is convex, whereby a distance between the first end of the rib and the protrusion decreases. An opening adapted to receive a bypass orifice filter insert can be defined in the diaphragm body. The diaphragm body can also include an inner ring attached to the outer periphery of the diaphragm body, an outer ring, and a plurality of longitudinally-extending bands connected to the inner ring and the outer ring.

The present invention provides for a flush valve diaphragm assembly for use in a flush valve. The assembly includes a flexible diaphragm body as previously discussed and a bypass orifice filter insert as previously discussed mounted within the diaphragm body.

The present invention provides for a flush valve that includes a valve body having an inlet and an outlet, and a barrel section having a sealing end positioned within the valve body. The sealing end is defined between the inlet and the outlet, wherein the barrel section adapts to fluidly connect the inlet to the outlet. The flush valve also includes a diaphragm assembly as previously discussed positioned in the valve body and separating the inlet and the outlet. The diaphragm assembly is configured to have a pressure difference applied across the diaphragm assembly, wherein the second side of the diaphragm body is concave and the first side of the diaphragm body is convex. The second side of the diaphragm assembly is adapted to seal against the sealing end of the barrel section. The recessed area is adapted to receive the sealing end of the barrel section, whereby a distance between the first end of the rib and the protrusion decreases as the diaphragm body is flexed, thereby causing the protrusion and the first end of each rib to squeeze against the barrel section, thus preventing the recessed area of said diaphragm body from sealing too quickly against the sealing end of the barrel section.

The present invention provides for a method of compensating for a fluid pressure difference across a flush valve diaphragm separating fluid within a flush valve as previously discussed. First, a flush valve diaphragm assembly as previously discussed is provided. Second, the flush valve diaphragm assembly is positioned in the flush valve between the inlet and the outlet of the flush valve. Third, a pressure difference is applied across the diaphragm body such that the pressure on the first side of the diaphragm body is lower than the pressure on the second side of the diaphragm body. Fourth, the diaphragm body is flexed such that the second side of the diaphragm body is concave and the first side of the diaphragm body is convex, wherein the recessed area is adapted to receive the sealing end of the barrel section, whereby a distance between the first end of the rib and the protrusion changes as fluid flows through the bypass orifice filter insert.

DETAILED DESCRIPTION OF THE PREFERRED EMBODIMENTS

Figure 1:
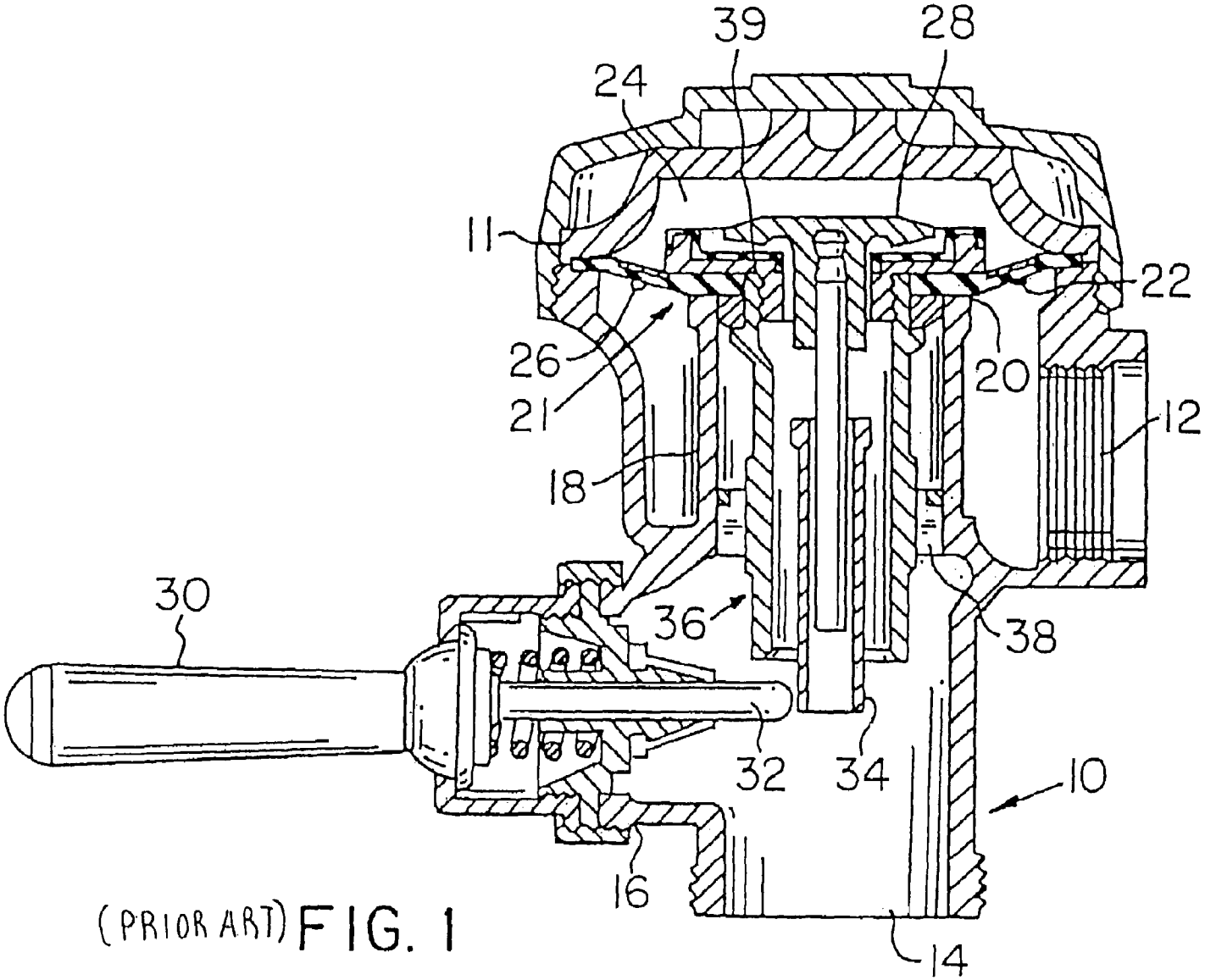
FIG. 1 is a partial sectional view of a prior art flush valve and conventional diaphragm assembly.

Flush valves in water closets, urinals, and other plumbing devices which utilize a flexible diaphragm to establish and to seal off the connection between the inlet and outlet are well known in the art. FIG. 1 illustrates a typical prior art flush valve and diaphragm assembly. The flush valve has a hollow valve body 10, generally made of brass, which includes an inlet 12, an outlet 14, and a handle connection 16. A barrel section 18 is positioned within the flush valve such that the connection between the inlet 12 and the outlet 14 is through the barrel section 18. An annular main valve seat 20 is formed on a top or sealing end 21 of the barrel section 18. The annular main valve seat 20 is normally closed by a diaphragm 22 extending across the body 10 and defining an upper chamber 24. The diaphragm 22 has a bypass 26 which provides fluid communication between the inlet 12 of the flush valve and the upper chamber 24. The diaphragm 22 is attached at its outer edge to the valve body 10 and is clamped in place by an annular clamping rim on an outer cover 11 of the body 10. The diaphragm 22 has an opening which allows for fluid communication between the upper chamber 24 and the outlet 14. A relief valve 28 normally closes the opening at the center of the diaphragm 22.

The operation of the flush valve is generally as follows. In the normally closed position shown in FIG. 1, water pressure at the valve inlet 12 is communicated to the upper chamber 24 through a bypass 26 defined in the diaphragm 22. Because the surface area which is subjected to water pressure is greater on the upper side of the diaphragm 22, the water pressure forces the diaphragm 22 down onto the sealing end 21 of the barrel section 18 (i.e., main valve seat 20), thus preventing water from flowing to the outlet 14. When the user moves a handle 30 in any direction, a plunger 32 moves inwardly tilting a stem 34 of the relief valve 28. This releases the pressure in upper chamber 24 by allowing water to flow through a guide member 36. With the upper chamber pressure relieved, the inlet water pressure forces the diaphragm 22 upwardly, off the main valve seat 20, allowing water to flow directly from the inlet 12 through the barrel section 18 to the outlet 14. When the diaphragm 22 and the relief valve 28 move upwardly, the relief valve 28 resets itself, closing off the upper chamber 24. Water will then flow through the bypass 26 into the upper chamber 24 until the diaphragm 22 is again forced against the main valve seat 20, thereby closing the valve. The guide member 36 moves with the diaphragm 22 and includes outwardly-extending radial wing members 38 which engage the inner surface of the barrel section 18 to guide the guide member 36 and the attached diaphragm 22, as the diaphragm 22 moves up and down. The diaphragm 22 defining a central passageway 39 (i.e., hole) is radially spaced from the central passageway 39.

Figure 2:
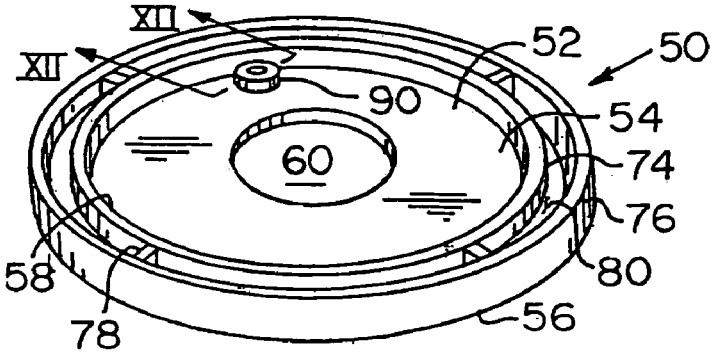
FIG. 2 is a top perspective view of a flush valve diaphragm assembly made in accordance with the present invention.
Figure 3:
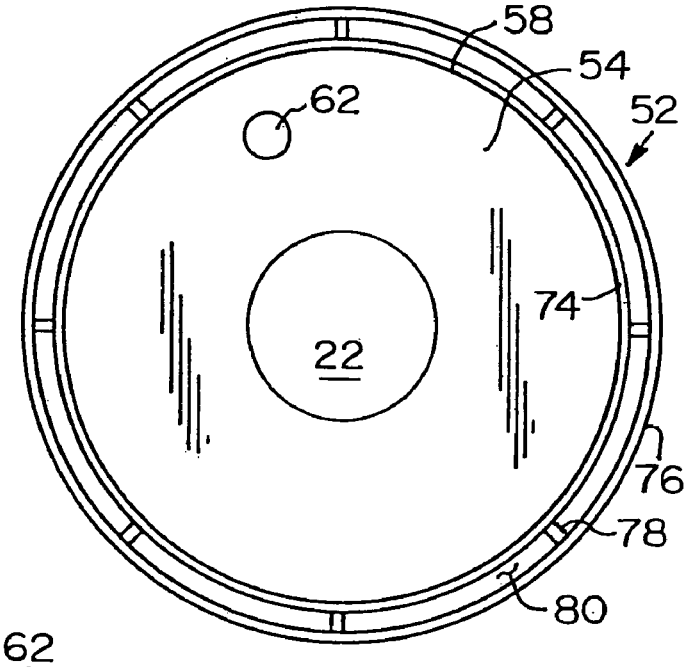
FIG. 3 is a top plan view of a diaphragm body of the diaphragm assembly shown in FIG. 2.
Figure 4:
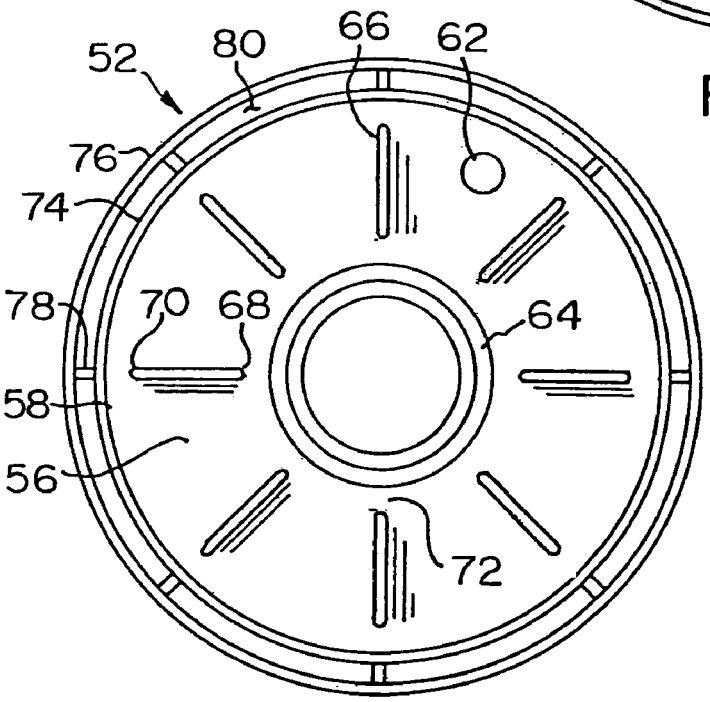
FIG. 4 is a bottom plan view of the diaphragm body shown in FIG. 3.

FIG. 2 shows a flush valve diaphragm assembly 50 made in accordance with the present invention. The diaphragm assembly 50 is designed to replace the diaphragm 22 and bypass 26 in the prior art flush valve as shown, for example, in FIG. 1. The diaphragm assembly 50 operates in an analogous manner to the diaphragm 22 and bypass 26 as previously described. Like reference numerals refer to like parts throughout. The diaphragm assembly 50 includes a flexible diaphragm body 52 having a first side 54 and a second side 56 and defining an outer periphery 58 and a bypass orifice filter insert 90 defined in the diaphragm body 52.

Referring to FIGS. 2-5, the diaphragm body 52 defines a center passageway 60, an opening 62 spaced radially from the center passageway 60, an annular protrusion 64 on the second side 56 of the diaphragm body 52 adjacent the center passageway 60, and a plurality of protruding ribs 66 having a first end 68 and a second end 70 on the second side 56 of the diaphragm body 52 adjacent the protrusion 64. The opening 62 can be adapted to receive the bypass orifice filter insert 90 as shown in FIG. 2. The ribs 66 can be evenly circumferentially spaced from one another.

Figure 5:
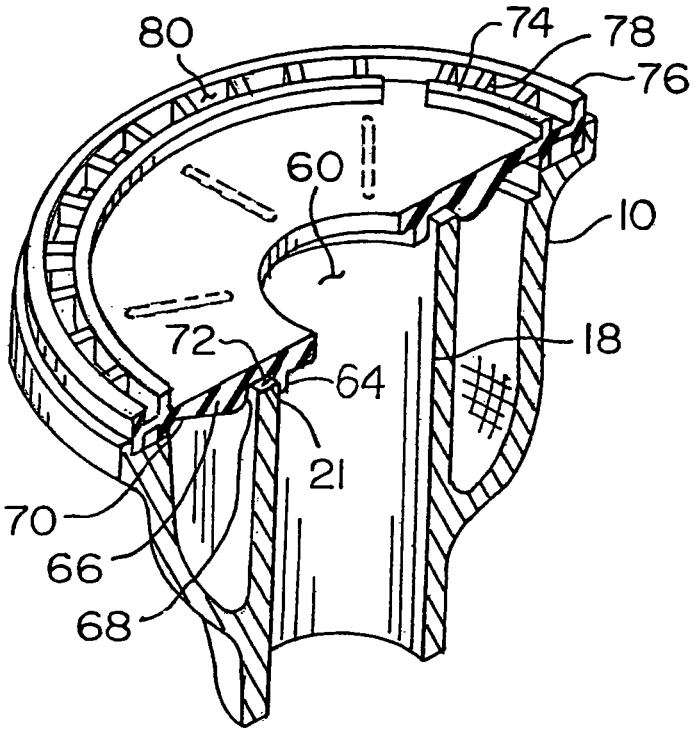
FIG. 5 is a top perspective view, partially in section, of the diaphragm assembly shown in FIG. 2 in a first position seated in a valve body.

With continued reference to FIGS. 2-5, the first end 68 of each rib 66 extends radially outward away from the center passageway 60 toward the second end 70 of the rib 66. The first end 68 of each rib 66 also extends axially outward away from the second side 56 of the diaphragm body 52 and tapers off toward the second end 70 of the ribs 66, thereby defining a general L-shaped profile as shown in FIG. 5. The annular protrusion 64 is defined on the second side 56 of the diaphragm body 52 adjacent the center passageway 60. The first end 68 of each rib 66 and the protrusion 64 define a recess area 72 therebetween. The ribs 66 provide strength to the diaphragm body 52 in order to prevent distortion that results from flexing of the diaphragm body 52 due to compression. The recess area 72 is adapted to receive a sealing end 21 of a barrel section 18 in a valve body 10 as shown in FIG. 5. The diaphragm body 52 can be annular shaped and made of a flexible polymeric material, such as rubber. Although not shown, the diaphragm assembly 50 can be connected to a barrel, which can be integrally formed thereto or attached as a separate piece, as shown in U.S. Pat. No. 6,299,128 B1.

With continued reference to FIGS. 2-5, the diaphragm body 52 can also include an inner ring 74 attached to the outer periphery 58 of the diaphragm body 52, an outer ring 76, and a plurality of longitudinally-extending bands 78 connected to the inner ring 74 and the outer ring 76. A plurality of cavity sections 80 can be defined between the inner ring 74 and the outer ring 76. Each cavity section 80 is separated by the bands 78.

Figure 6:
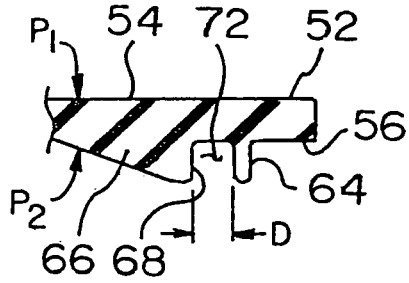
FIG. 6 is a sectional view of a portion of the diaphragm assembly shown in FIG. 2 with the diaphragm body in a first position.
Figure 7:
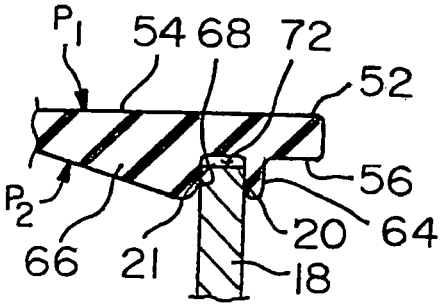
FIG. 7 is a sectional view of a portion of the diaphragm body in a first position as shown in FIG. 6 sealed against a sealing end of a barrel section in the valve body shown in FIG. 5.

FIGS. 6 and 7 show a portion of the diaphragm body 52 in an unflexed position (i.e., normal or first position), wherein pressure $P_1$ on the first side 54 and pressure $P_2$ on the second side 56 of the diaphragm body 52 are the same or approximately the same. This condition exists when the diaphragm assembly 50 is seated on the valve seat 20 (i.e., sealing end 21 of the barrel section 18) before the flush valve (shown in FIG. 1) is activated. The distance D between the first end 68 of the ribs 66 and the protrusion 64 is such that the sealing end 21 of the barrel section 18 can be received by the recess area 72 of the diaphragm body 52 as shown in FIG. 7.

Figure 8:
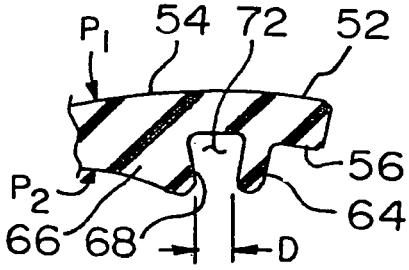
FIG. 8 is a sectional view of a portion of the diaphragm assembly shown in FIG. 2 with the diaphragm body in a second position.
Figure 9:
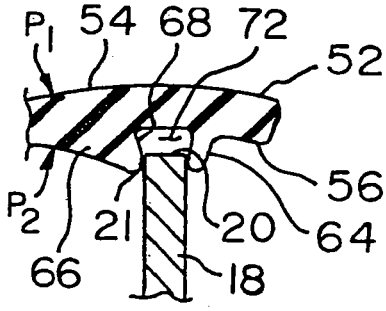
FIG. 9 is a sectional view of a portion of a diaphragm body in a second position as shown in FIG. 8 with a rib and protrusion of the diaphragm body contacting a barrel section.

FIGS. 8 and 9 show a portion of the diaphragm body 52 in a flexed position (i.e., second position) having a pressure difference $\Delta P$ ($P_2 > P_1$) across the diaphragm body 52, wherein the pressure $P_2$ on the second side 56 of the diaphragm body 52 is greater than the pressure $P_1$ on the first side 54 of the diaphragm body 52. When this pressure difference occurs, the second side 56 of the diaphragm body 52 is concave and the first side 54 of the diaphragm body 52 is convex. As can be seen in FIG. 8, the distance D between the first end 68 of the ribs 66 and the protrusion 64 decreases due to the flexing of the diaphragm body 52. This condition exists immediately after the flush valve is activated. During the period of time after the flush valve is activated, water flows through the bypass orifice filter insert 90 in the diaphragm body 52 (not shown). As the diaphragm body 52 begins to force itself against the sealing end 21 of the barrel section 18 (i.e., the main valve seat 20), the first end 68 of the ribs 66 and the protrusion 64 squeeze against the barrel section 18 before the sealing end 21 of the barrel section 18 is received within the recess area 72 of the diaphragm body 52. This squeezing of the barrel section 18 helps prevent the diaphragm assembly 50 from closing too quickly against the sealing end 21 of the barrel section 18, thus preventing water hammer of the flush valve. As pressure $P_1$ and pressure $P_2$ become approximately equal due to water flowing to the upper chamber 24 through the bypass orifice filter insert 90, the diaphragm body 52 closes on the valve seat 20.

Figure 10:
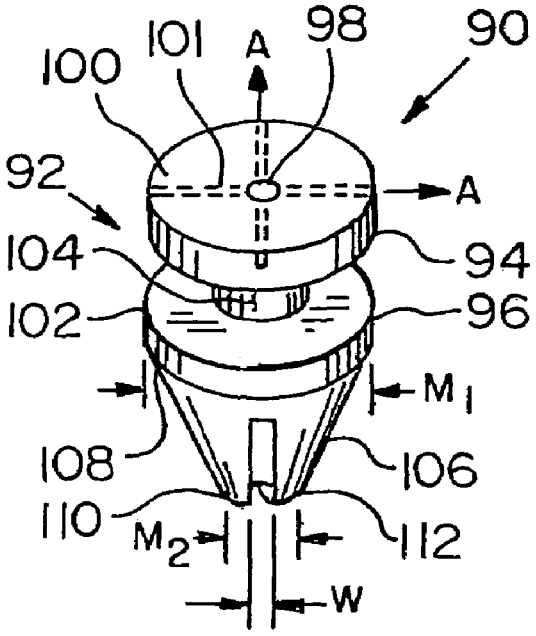
FIG. 10 is a top perspective view of a bypass orifice filter insert of the diaphragm assembly as shown in FIG. 2.
Figure 11:
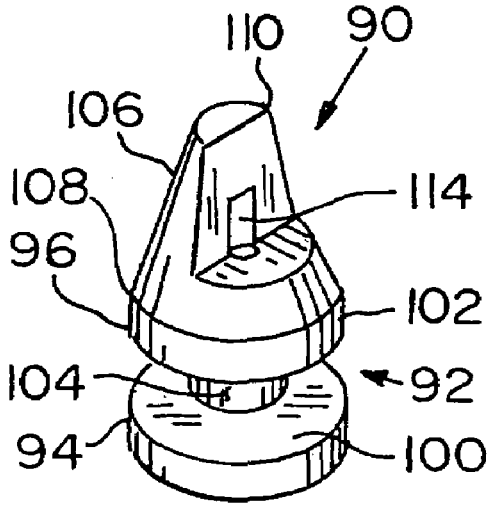
FIG. 11 is a top perspective view, partially in section, of the bypass orifice filter insert shown in FIG. 10.
Figure 12:
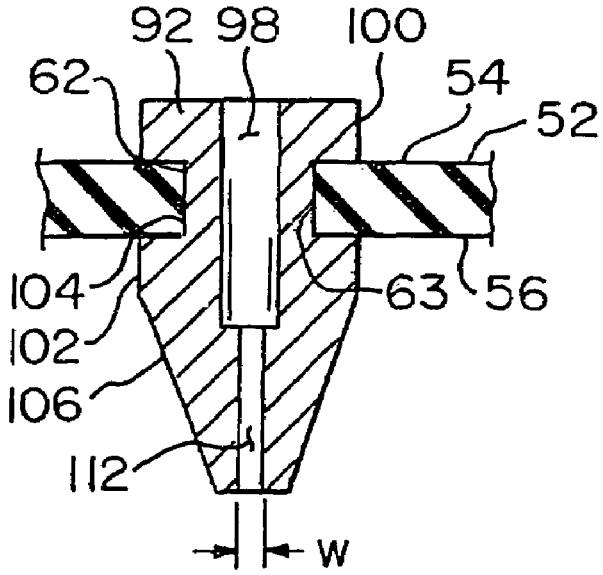
FIG. 12 is a sectional view taken along lines XII-XII of the diaphragm assembly shown in FIG. 2.

Referring to FIGS. 10 and 11, the bypass orifice filter insert 90 includes an annular-shaped first body 92 having a first end 94 and a second end 96 and defining an orifice 98 integrally attached to a tapered or frusto-conical-shaped second body 106. Alternatively, the second body 106 may include other shapes other than frusto-conical, such as frusto-spherical, or frusto-pyramidical shaped. In this manner, a first diameter end 108 tapers to a second diameter end 110 of the second body 106, wherein an outer diameter $M_1$ at the first diameter end 108 is greater than an outer diameter $M_2$ at the second diameter end 110 of the second body 106 (shown in FIG. 10). This tapered surface allows debris to fall off easier than with a planer surface. Also, the bypass orifice filter insert 90 is easier to assemble when passing the tapered second body 106 through the opening 62 in the diaphragm body 52. The first body 92 includes a first flange 100 attached to the first end 94 of the first body 92 and a second flange 102 attached to the second end 96 of the first body 92. A cruciform-shaped recess 101 (shown in phantom) can be defined on a surface of the first flange 100. The recess 101 can have a depth of several thousandth inch. In some instances, the bypass orifice filter insert 90 may abut against the outer cover 11 of the valve body 10 after flushing, thereby covering the orifice 98. The cruciform-shaped recess 101 then permits water to flow therethrough while the upper chamber 24 fills with water until the orifice 98 is not blocked by the outer cover 11, so that water may flow radially therethrough out the perimeter of the first flange 100 as indicated by arrows A. A recessed area 104 is defined between the first flange 100 and the second flange 102 of the first body 92. The diameter of the orifice 98 may, for example, range from 0.014 to 0.022 inch, preferably 0.018 inch. The second body 106 defining a slit 112 is attached to the second flange 102 of the first body 92. The slit 112, which is open on a top side, a bottom side, a first lateral side and a second lateral side opposite the first lateral side of the second body 106, is in fluid communication with the orifice 98 in the first body 92. Accordingly, the slit 112 can be in direct fluid communication with the orifice 98. The second body 106 can also define a hole 114 (shown in FIG. 11), wherein the orifice 98 of the first body 92 is in fluid communication with the slit 112 in the second body 106 via the hole 114 in the second body 106. As shown in FIGS. 11 and 12, the hole 114 has a diameter equal to the diameter of the orifice 98. The width W of the slit 112 may, for example, range from 0.006 to 0.014 inch, preferably 0.010 inch. Preferably, the width W of the entire length of the slit 112 is not the same as the diameter of the orifice 98. For example, the width W of the entire length of the slit 112 can be less than the diameter of the orifice 98. The slit 112 in the second body 106 acts as a filter protecting the orifice 98 from getting clogged with debris from fluid passing through the bypass orifice filter insert 90. The first body 92 arid the second body 106 of the bypass orifice filter insert 90 can be made from a rigid plastic material and from a unitary piece of molded material.

FIG. 12 shows a sectional view of the bypass orifice filter insert 90 inserted into the opening 62 of the diaphragm body 52, wherein the bypass orifice filter insert 90 extends from the first side 54 to the second side 56 of the diaphragm body 52. The first body 92 is defined on the first side 54 of the diaphragm body 52 and the second body 106 of the orifice filter insert 90 is defined on the second side 56 of the diaphragm body 52, wherein the recessed area 104 receives an outer edge 63 in the opening 62 of the diaphragm body 52.

In operation, the diaphragm assembly 50 provides sealing in diaphragm-type flush valves as in FIG. 1 of the prior art. Because compression is needed in order for the diaphragm assembly 50 to seal, the diaphragm assembly 50 must be flexible enough to flex in two directions and strong enough to withstand the compression forces. The ribs 66 and annular protrusion 64 give the diaphragm assembly 50 strength and rigidity, thus helping to prolong the service life of the diaphragm assembly 50. The bypass orifice filter insert 90 determines the rate at which water flows into the upper chamber 24 (shown in FIG. 1) of a flush valve above the diaphragm assembly 50. The orifice filter insert 90 also determines the water pressure within the upper chamber 24 which causes the diaphragm assembly 50 to close on the valve seat 20.

A normally closed position (i.e., first position) of a flush valve is where the pressure $P_1$ on the first side 54 of the diaphragm assembly 50 is the same or approximately the same as the pressure $P_2$ on the second side 56, whereby the pressure $P_1$ forces the diaphragm assembly 50 on the sealing end 21 of the barrel 18 (shown in FIGS. 5 and 7), thus terminating the operation of the flush valve. In the normally closed position, the diaphragm assembly 50 is relatively flat, wherein the sealing end 21 is received in the recess area 72 of the diaphragm body 52. When a flush valve trip mechanism is activated, this relieves pressure $P_1$ in the upper chamber 24 by allowing water to flow through the passageway 39 and to the flush valve outlet 14 (shown in FIG. 1). With the upper chamber 24 pressure $P_1$ relieved, the inlet water pressure forces the diaphragm assembly 50 upward, off of the valve seat 20. In this open position (i.e., second position), the diaphragm assembly 50 is flexed, wherein the second side 56 is concave and the first side 54 is convex. In this second position, the distance D between the first end 68 of each rib 66 and the protrusion 64 is decreased. As water flows through the bypass orifice filter insert 90, the diaphragm assembly 50 moves toward the sealing end 21 of the barrel section 18 (shown in FIG. 9) while still in the flexed position. The first end 68 of each rib 66 and the protrusion 64 squeeze against the barrel section 18 which helps prevent the diaphragm assembly 50 from closing too quickly against the sealing end 21 of the barrel section 18, thus preventing water hammer of the flush valve. As pressure $P_1$ and pressure $P_2$ become approximately equal due to water flowing to the upper chamber 24 through the bypass orifice filter insert 90, the diaphragm body 52 closes on the valve seat 20.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A bypass orifice filter insert for use in a flush valve diaphragm, comprising:

a first body having ends, said first body defining an orifice having a diameter;

a flange attached to each end of said first body; and a second body attached to one of said flanges, said second body defining a slit open on a top side, a bottom side and at least one other side of said second body, said slit of said second body in fluid communication with said orifice in said first body, wherein the width of the entire length of said slit is less than the diameter of said orifice, wherein said second body further defines a hole having a diameter equal to the diameter of said orifice, and wherein said orifice in said first body is in fluid communication with said slit in said second body via said hole in said second body.

2. The bypass orifice filter insert as claimed in claim 1, wherein said first body is annular shaped and said second body has a first diameter end that tapers to a second diameter end, wherein an outer diameter at the first diameter end is greater than an outer diameter at the second diameter end.

3. The bypass orifice filter insert as claimed in claim 1, wherein a first flange is attached to one end of said first body and a second flange is attached to an opposite end of said first body, said first flange and said second flange defining a recessed area therebetween.

4. The bypass orifice filter insert as claimed in claim 1, wherein a width of said slit in said second body is in a range from 0.006 to 0.014 inch.

5. The bypass orifice filter insert as claimed in claim 1, wherein said first body and said second body are made from a unitary piece of molded material.

6. The bypass orifice filter insert as claimed in claim 1, further comprising a recess defined in said first body in fluid communication with said orifice.

* * * * *